United States Patent [19]

Mettler

[11] 3,935,623

[45] Feb. 3, 1976

[54] YARN SINGEING BURNER CONSTRUCTION

[75] Inventor: Hermann Mettler, Arth, Switzerland

[73] Assignee: Aktiengesellschaft Fr. Mettler's Söhne Maschinenfabrik, Switzerland

[22] Filed: Dec. 30, 1974

[21] Appl. No.: 537,326

[30] Foreign Application Priority Data

Jan. 17, 1974 Switzerland ..... 646/74
Aug. 20, 1974 Switzerland ..... 11355/74

[52] U.S. Cl. ..... 28/63; 432/59
[51] Int. Cl.[2] ..... D02J 13/00; D02J 3/16
[58] Field of Search ..... 28/55.2, 63; 432/8, 59

[56] References Cited

UNITED STATES PATENTS

| | | | |
|---|---|---|---|
| 3,402,447 | 9/1968 | Mehler | 28/63 |
| 3,447,214 | 6/1969 | Heimes | 28/63 |

*Primary Examiner*—Carroll B. Dority, Jr.
*Attorney, Agent, or Firm*—McGlew and Tuttle

[57] ABSTRACT

A yarn singeing burner, comprises a housing which has a vertical yarn passage defined threthrough, and a front wall having an entrance opening to the yarn passage. An insert member is located within the passage, and has a wall portion spaced inwardly from the housing, so as to define a burner fuel and air chamber therebetween. The insert member is provided with a plurality of apertures for the passage of a singeing flame jet which is generated by the burning of fuel and air which is directed into the fuel and air chamber, defined between the insert and the housing. A yarn guiding channel extends through the yarn passage between the flame jets and the yarn, and it has an open side which is opened to the entrance for the passage of the yarn therethrough. The channel member may be of triangular configuration and may be provided with a plurality of apertures for the passing of the heating gases therethrough, or with unperforated walls which, for example, may be of a wave-shape configuration, or the channel may include a wall with spaced interruptions on each side thereof extending along its height for the purpose of exposing the yarn passing therethrough to alternate areas of flame and shielding.

9 Claims, 6 Drawing Figures

YARN SINGEING BURNER CONSTRUCTION

FIELD AND BACKGROUND OF THE INVENTION

The present invention relates particularly to a yarn singeing burner which are in themselves well-known. The known burners include a gas distributing channel adjacent the outside of the housing wall and the flames of a burning air and gas mixture pass into the gas distributing chamber and act on the yarn to be singed. A disadvantage in the known devices is that they are constructed so that there is a possibility that the yarn may be unevenly exposed to the heating gas action and the singeing may also be uneven.

SUMMARY OF THE INVENTION

The present invention provides a yarn singeing burner which makes it possible to obtain an absolutely uniform influence of the heat on the yarn to be singed and to concentrate the flames to the yarn surface without causing their penetration to the core of the yarn. The invention provides a burner which includes a guide channel forming a shield between the individual flame jets and through which the yarn is passed and guided within narrow limits and such as to avoid vibration and irregularities in the singeing effect. For this purpose, the burner is provided with a yarn guiding channel which extends centrally through the heating chamber, and which has an opening which is aligned with the entrance opening to the heating chamber.

Accordingly, it is an object of the invention to provide a yarn singeing burner having a burning chamber with an entrance opening and with a guide channel extending through the chamber which opens into the entrance and which provides a guideway for the passage of the yarn therethrough.

A further object of the invention is to provide a yarn singeing burner which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

DESCRIPTION OF THE PREFERRED EMBODIMENTS

Figure 1:
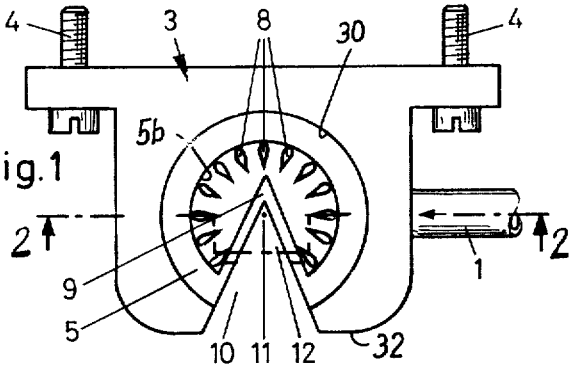
FIG. 1 is a top plan view of the yarn singeing burner constructed in accordance with the invention.
Figure 2:
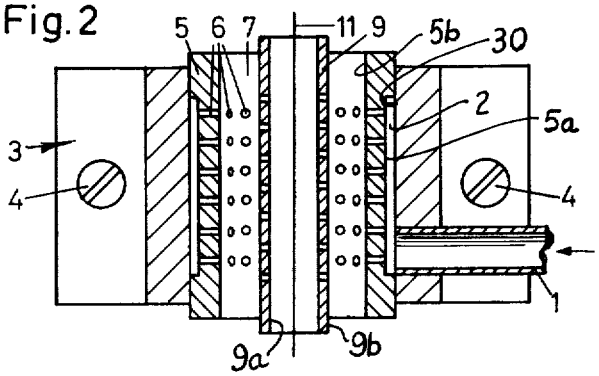
FIG. 2 is a section taken along the line 2—2 of FIG. 1.

Referring to the drawings in particular, the invention embodied therein, comprises, as shown in FIGS. 1 and 2, a housing, generally designated 3, having a vertically extending yarn passage bore 30 therethrough. Housing 3 includes a front wall 32 having an entrance opening 10 into the passage 30. Housing 3 is secured in position on a frame (not shown) by means of securing bolts 4. A burner insert member or shell 5 is positioned in the bore 30 and extends the full height thereof and is also provided with a yarn receiving opening 12 which faces outwardly to the entrance opening 10 in front wall 32.

In accordance with the invention, insert 5 has an interior wall 5*a* which is spaced inwardly from the interior wall of housing 3 and defines a fuel and air chamber 2 which is supplied with fuel and air for combustion purposes through inlet means which includes an inlet conduit 1. Insert member 5 is advantageously provided with a plurality of perforations 6 so that combustion gases or flame generated in chamber 2 penetrates through the perforations 6 in the form of flame jets 8 which are directed around an arcuate inner wall 5*b* of the insert in a direction toward the center of bore 30.

In accordance with the invention, a yarn guiding channel 9 extends throughout the height of the heating space defined within the interior wall 5*b* and it includes side walls 9*a* and 9*b* which diverge outwardly from the central portion of the heating space to each side of the entrance opening 10. The guide channel 9 includes a lateral opening 12 which is aligned with the entrance opening 10 so that the yarn 11 may be easily positioned within the channel. In the embodiment of FIGS. 1 and 2, the side walls 9*a* and 9*b* are perforated, so that the heating gases may penetrate uniformly along the height thereof and treat the yarn by singeing it in a desirable manner. Yarn 11 is moved from a supply bobbin (not shown) and moves at an adjusted speed to the winding bobbin (also not shown) after passage through the middle of the yarn guiding channel 9.

Upon ignition of the gas mixture which is introduced into chamber 2, flames 8 are formed which are diagrammatically indicated in FIG. 1, and they produce their effect on the yarn guiding channel 9. Flames 8 impinge on the surface of yarn guiding channel 9 and the dynamic and thermal action of the flame tips, which are directed toward the center of the yarn passing through channel 9, is distributed. Thus, the flames cannot act directly on the material to be singed and cannot penetrate the material to its innermost core. The heat produced by the flames concentrates in the zone immediately adjacent the surface of the yarn which passes through guide channel 9 and it is distributed uniformly over the entire length of the gas burner, thereby permitting a uniform singeing of the fiber ends projecting from the yarn.

Aside from the fact that it produces an excellent singeing effect, the burner of the invention has the further advantage of requiring much less cleaning than conventional burners. The yarn passes very close to the wall 9*a* and 9*b* of the yarn guiding channel 9, and these walls are heated so intensely that any residues are completely carbonized and entrained by the running yarn, due to slight friction. The yarn is well-guided in the yarn guiding channel 9 and cannot suffer strong vibrations in the burner. The yarn passes always at the same place and snarls have no effect on the flame since the yarn is guided past the two walls 9*a* and 9*b* which form the channel 9 independently of the yarn thickness.

The burner of FIGS. 1 and 2 is particularly suitable for singeing synthetic fibers, where only a surface treatment is permitted, and which must not be heated to their innermost core. Thus, the singeing process cannot affect the quality of the yarn, that is, it cannot reduce the strength of the yarn. It has also been found that, because of the increased heat concentration, the invention burner makes it possible to increase the singeing speed.

Figure 3:
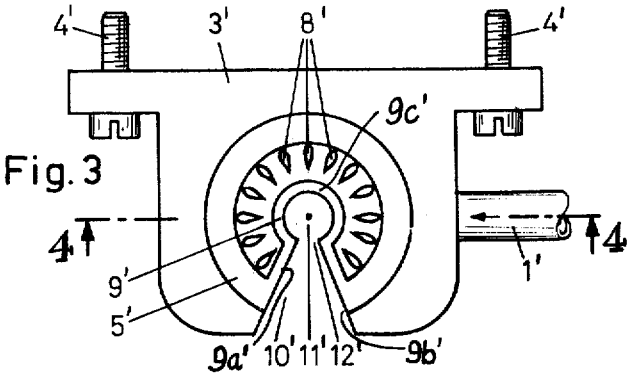
FIG. 3 is a view similar to FIG. 1 of another embodiment of the invention.
Figure 4:
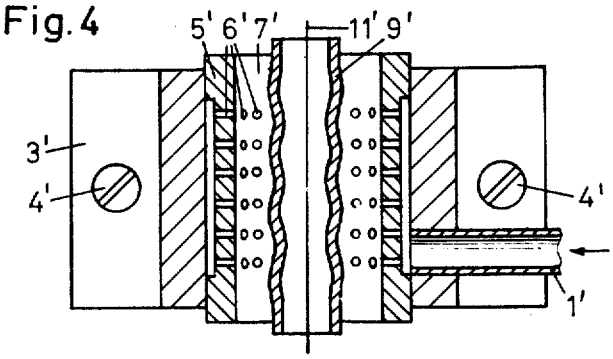
FIG. 4 is a section taken along the line 4—4 of FIG. 3.

In the embodiment of burner shown in FIGS. 3 and 4, similar parts are similarly designated, but with primes. In this construction, the guide channel 9' includes a central annular wall portion 9c', which connect the radial wall portions 9a' and 9b', respectively. In the preferred arrangement, the annular sector portion 9c' is made of wave-shape configuration along its longitudinal axis. This undulatory wall formation of the sector 9c' of guiding channel 9' favors the thermal action on the yarn 11'. A direct escape of the hot air is hindered by this construction, and an intense air turbulence is produced which causes an agitation of the spun-in fibers, so that the longest fiber ends are singed. The construction shown in FIGS. 3 and 4 may also be employed with an annular sector portion 9c' which has a straight wall formation. In addition, this portion may be made either solid or with perforations and, depending on the size or number of perforations, the flames can act on the yarn with varying intensity. This makes it possible to adapt the burner inserts to the different kinds of yarns without incurring notable costs.

It is also possible to include guide channels 9' which have divergent walls 9a' and 9b' arranged on each side, so that the yarn may be induced from either side.

Figure 5:
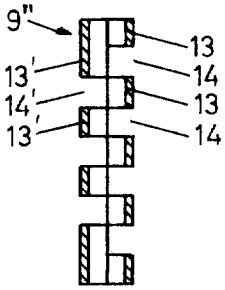
FIGS. 5 and 6 are partial sectional views taken in the same vicinity as FIG. 4 of still other embodiments of yarn guide channel.
Figure 6:
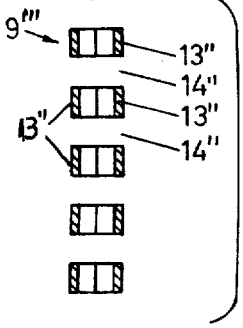

Further embodiments of yarn guide channels are shown in FIGS. 5 and 6 and are designated 9'' and 9''', respectively. In the embodiment shown in FIG. 5, guide channel 9'' includes side walls or tongues 13 and 13' which are provided with openings 14 and 14' which are offset in a vertical direction so that the yarn 11', which passes through the center thereof, is alternately exposed to the action of the flames on respective alternate sides. Depending on the configuration of the yarn guide 9'', the size and the number of openings may be varied, in order to vary the flame action acting on the yarn either intermittently or directly. This makes it possible to adapt the elements of the burner in a relatively inexpensive manner to a great variety of presently marketed yarns, and also to new fibers which may be manufactured in the future.

In the embodiment of FIG. 6, the guide channel 9''' includes side walls 13'' which are provided with aligned openings 14'', which are uniformly spaced along the height thereof. The two embodiments of FIGS. 5 and 6 make it possible to run the yarn over the solid portion of the guide channel immediately after its direct exposure to the flames and thereby to back off the singeing action. This sort of treatment is repeated in accordance with the number of openings in the guide channel.

While specific embodiments of the invention have been shown and described in detail to illustrate the application of the principles of the invention, it will be understood that the invention may be embodied otherwise without departing from such principles.

What is claimed is:

1. A yarn singeing burner, comprising a housing having a yarn passage therethrough and a wall having an entrance opening into said yarn passage, an insert member disposed in said yarn passage and having a portion spaced inwardly from said housing and defining a burner fuel and air chamber between said insert member and said housing, said insert member having a plurality of apertures for the passage of singeing flame jets therethrough, means for supplying fuel and air to said burner fuel and air chamber for ignition therein to generate singeing flame jets, and a yarn guiding channel extending through said yarn passage between the flame jets and the yarn and having an open side opening to the entrance for the passage of the yarn therethrough.

2. A yarn singeing burner, according to claim 1, wherein said yarn guiding channel includes spaced side walls which diverge outwardly to the entrance.

3. A yarn singeing burner, according to claim 1, wherein said yarn guiding channel includes first and second side walls which diverge outwardly to said entrance and which are perforated.

4. A yarn singeing burner, according to claim 1, wherein said yarn guiding channel comprises a central cylindrical portion with a side wall extending radially outwardly from each side of said cylindrical portion and opening to said entrance.

5. A yarn singeing burner, according to claim 4, wherein said central cylindrical portion is of wave-shape configuration.

6. A yarn singeing burner, according to claim 1, wherein said yarn guiding channel includes perforated walls.

7. A yarn singeing burner, according to claim 1, wherein said yarn guiding channel includes side wall portions having a plurality of openings therein spaced along the longitudinal axis.

8. A yarn singeing burner, according to claim 7, wherein the openings in respective side walls are offset.

9. A yarn singeing burner, according to claim 7, wherein the openings in the respective side walls are aligned.

* * * * *